US010393359B1

(12) United States Patent
Qi et al.

(10) Patent No.: US 10,393,359 B1
(45) Date of Patent: Aug. 27, 2019

(54) EMBEDDED LED DOWNLIGHT

(71) Applicant: SHANGHAI HAIFENG ELECTRICAL LIGHTING CO., LTD, Shanghai (CN)

(72) Inventors: Jianhua Qi, Shanghai (CN); Yuanfa Shi, Shanghai (CN)

(73) Assignee: SHANGHAI HAIFENG ELECTRICAL LIGHTING CO., LTD, Shanghai (CN)

( * ) Notice: Subject to any disclaimer, the term of this patent is extended or adjusted under 35 U.S.C. 154(b) by 0 days.

(21) Appl. No.: 15/994,155

(22) Filed: May 31, 2018

(30) Foreign Application Priority Data

Mar. 5, 2018 (CN) ..... 2018 1 0178770

(51) Int. Cl.

| | |
|---|---|
| ***F21S 8/02*** | (2006.01) |
| ***F21V 23/00*** | (2015.01) |
| ***F21V 21/04*** | (2006.01) |
| ***F21V 17/12*** | (2006.01) |
| ***F21V 29/70*** | (2015.01) |
| ***F21V 15/01*** | (2006.01) |
| ***F21V 23/02*** | (2006.01) |
| ***H05B 33/08*** | (2006.01) |
| *F21Y 115/10* | (2016.01) |

(52) U.S. Cl.
CPC ..... *F21V 29/70* (2015.01); *F21V 15/01* (2013.01); *F21V 21/04* (2013.01); *F21V 23/023* (2013.01); *H05B 33/0806* (2013.01); *F21Y 2115/10* (2016.08)

(58) Field of Classification Search
CPC ..... F21S 8/026; F21V 29/70; F21V 23/023; F21V 15/01; F21V 21/04; H05B 33/0806
See application file for complete search history.

(56) References Cited

U.S. PATENT DOCUMENTS

| | | | | |
|---|---|---|---|---|
| 9,310,038 | B2 * | 4/2016 | Athalye | F21V 21/00 |
| 2011/0075414 | A1 * | 3/2011 | Van De Ven | F21V 15/01 362/235 |

(Continued)

*Primary Examiner* — Joseph L Williams

(57) ABSTRACT

An embedded LED downlight disclosed herein includes a main housing and a junction box fixedly connected to each other, wherein the main housing is of cylindrical structure having an open end, a closed end and an accommodating space formed therein; a light transmission component is fixed to an opening at the open end; an LED light-emitting assembly and an IC constant-current power supply are disposed in the accommodating space; the closed end of the main housing is fixedly connected to the junction box; spring clips are hinged at symmetrical positions on an outer circumferential surface of the main housing close to the opening, respectively; and the main housing and the junction box are both made of flame-resistant plastic material at a fireproofing grade of 5VA. The embedded LED downlight is entirely made of flame-resistant plastic material at a fireproofing grade of 5VA, and thus the lamp not only has a more compact overall structure and a less weight, but also is more convenience in installation and disassembly. Moreover, the embedded LED downlight disclosed herein has simple production process, high production efficiency and low material consumption, and further may be manufactured by injection molding, thereby reducing the production cost of the product.

10 Claims, 7 Drawing Sheets

(56) References Cited

U.S. PATENT DOCUMENTS

2015/0233537 A1* 8/2015 Athalye ..... F21S 8/026
362/147
2017/0307198 A1* 10/2017 Shah ..... F21K 9/68

* cited by examiner

EMBEDDED LED DOWNLIGHT

TECHNICAL FIELD

The present invention relates to a lamp, more particular to an embedded LED lamp.

BACKGROUND OF THE INVENTION

LED luminaires have become the predominant luminaires in the field of home lighting and commercial lighting due to their own advantages. However, high-efficiency LED luminaires still have difficulties in installation and maintenance as well as poor compatibility. Especially for embedded LED lamps, because they need to be installed in a narrow space, it is difficult to meet the requirements of the overall compact structure and the adjustable lighting direction.

For example, a modular embedded—type LED lamp disclosed in Chinese Patent No. CN203703887U is comprised of a lamp holder, a optical engine and an external power source, wherein the lamp holder includes a lamp ring, two supports, an adjustment bracket, a rotating frame and a spring sheet. Two supports are correspondingly arranged on the two sides of the lamp ring, and the bottom of each support is connected with the lamp ring. One or more positioning slots are symmetrically arranged on the two supports. The optical engine includes a gland, a lens, an LED light source assembly, a heat sinking component and an inner wire. A through hole in which internal threads are arranged is formed in the lateral side of the heat sinking component, and the through hole corresponds to the bottom of the rotating frame. The external power source is provided with connection ports at both ends, wherein the port at one end is connected to the commercial power, and the port at the other end is connected to the inner wire of the optical engine. After the lamp is installed, the irradiation angle can be adjusted manually such that the lamp can be used as both a downlight and a spotlight. However, in order to realize the adjustment of the irradiation angle of the LED lamp, the power source is separated from the lamp holder. Therefore, it is necessary to separately set a device for fixing the power source at the lamp installation position. This kind of lamp has difficulty and inconvenience in installation, storage and transportation.

For example, an integrative embedded downlight disclosed in Chinese Patent No. CN205480574U includes a lamp assembly. The lamp assembly includes a housing having an opening, an LED light source disposed in the housing, and a transparent plate covering the opening. The integrated embedded downlight also includes a power connection box fixedly connected to the outer top wall of the housing, and the LED light source is electrically connected to the power connection box. Only one spatial position is required during installation of this integrative embedded downlight, so as to prevent the power connection box and the lamp assembly from occupying different installation positions respectively, which not only saves the installation space of the integrative embedded downlight, but also reduces the installation procedure of the integrative embedded downlight, and enhances the convenience of installation and dismantlement of the integrative embedded downlight. However, such integrated embedded downlight does not allow the adjustment of the irradiation angle of the lamp such that the irradiation angle is single. In addition, the above-mentioned LED lamp uses metal parts so that the heavier mass is not conducive to transportation and storage.

SUMMARY OF THE INVENTION

The technical problem to be solved by the present invention is to provide an embedded LED downlight which has a compact and integrated structure, more convenience in installation and dismantlement, less weight and higher safety.

The technical solution for solving the above-mentioned technical problems in the present invention is described as follows: an embedded LED downlight comprising a main housing and a junction box fixedly connected to each other, wherein the main housing is of cylindrical structure having an open end, a closed end and an accommodating space formed therein; a light transmission component is fixed to an opening at the open end; an LED light-emitting assembly and an IC constant-current power supply are disposed in the accommodating space; the closed end of the main housing is fixedly connected to the junction box; spring clips are hinged at symmetrical positions on an outer circumferential surface of the main housing close to the opening, respectively; and the main housing and the junction box are both made of flame-resistant plastic material at a fireproofing grade of 5VA.

In order to facilitate the installation, the open end of the main housing is provided with an annular mounting surface extending outwards radially, the opening is formed at an inner side of the mounting surface, and the light transmission component is fixed to the opening by a mounting ring.

In order to facilitate the installation and disassembly, an inner circumferential surface of the mounting ring is provided with a first snap-fit projection projecting inwards, an edge of the light transmission component is mounded into the first snap-fit projection to be fixedly connected to the mounting ring, and an outer circumferential surface of the mounting ring is provided with a fixture block projecting outwards, an inner circumferential surface of the opening is provided with a first groove matching with the fixture block so that the mounting ring is fixed to the opening.

In order to render the internal structure more reasonable, a heat sinking component is fixed inside the main housing, the heat sinking component divides the accommodating space into an upper portion close to the open end and a lower portion close to the closed end, the LED light-emitting assembly is fixed in the upper portion and is also fixed on the heat sinking component, and the IC constant-current power supply is fixed in the lower portion.

In order to facilitate the installation and the fixing and positioning of various components at interval, an inner surface of the closed end of the main housing is provided with a first connecting post, a second connecting post and a third connecting post extending towards the opening, the first connecting post extends to the heat sinking component and is fixedly connected to the heat sinking component, the second connecting post extends to the IC constant-current power supply and is fixedly connected to the IC constant-current power supply, and the third connecting post has a connection hole exposing the outer surface of the closed end and is fixedly connected to the junction box.

In order to facilitate the positioning and the installation, an outer surface of the closed end of the main housing is provided with a second snap-fit projection extending outwards, a surface of the junction box which fixed to the main housing is provided with a second groove, and the second snap-fit projection is mounted into the second groove in snap-fit manner so that the junction box and the main housing are connected to each other.

In order to introduce a power supply, a connection wire is fixed on the IC constant-current power supply, the connection wire passes through the main housing and extends into the junction box, the peripheral wall of the junction box is provided with a plurality of holes through which an external power cable is inserted to connect to the connection wire.

In order to allow the adjustment of the irradiation angle of the LED lamp, the main housing comprises two portions mutually nested, respectively a first portion and a second portion, the second portion is a cylindrical component having an open end, a closed end and the accommodating space formed therein, and the first portion encloses the open end of the second portion from outside.

In order to facilitate the adjustment, the first portion comprises an annular circumferential surface extending in the same direction as the second portion and outside the second portion, the annular circumferential surface is provided with two hinge holes symmetrical to each other, an outer circumferential surface of the second portion is provided with two hinge shafts at symmetrical positions in a radial direction; and the hinge shafts are inserted into the hinge holes so that the second portion is rotatable around the hinge shaft with respect to the first portion.

In order to achieve a limiting and positioning functions when the lamp is rotated, a first tooth profile surrounding the hinge shaft is provided around the hinge shaft, a second tooth profile surrounding the hinge hole is provided around the hinge hole, and the first tooth profile and the second tooth profile have elasticity and engage with each other.

Compared to the prior art, the present invention has the following advantages: most portion of the embedded LED downlight is made of flame-resistant plastic material at a fireproofing grade of 5VA, and the lamp thus not only has a more compact overall structure and a less weight, but also is of great convenience in installation and disassembly. Moreover, the embedded LED downlight disclosed herein has simple production process, high production efficiency and low material consumption, and further may be manufactured by injection molding, thereby reducing the production cost of the product.

DETAILED DESCRIPTION OF PREFERRED EMBODIMENTS

Figure 1:
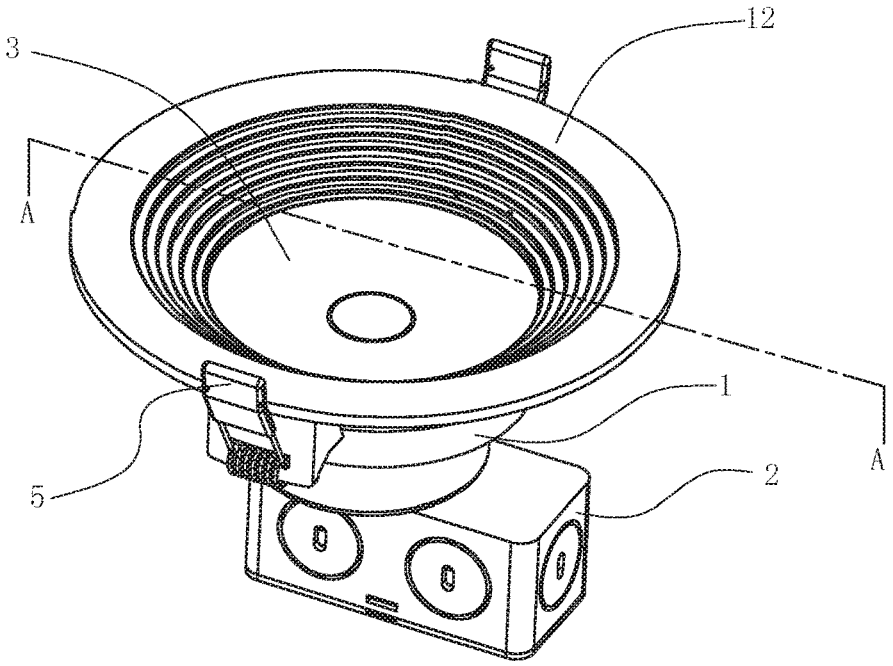
FIG. 1 is a schematic perspective view of an embedded LED downlight according to the first embodiment of the present invention.

The present invention will be further described in detail with reference to the embodiments accompanying drawings.

As shown in FIGS. 1-5, the embedded LED downlight of the first embodiment of the present invention includes a main housing 1 and a junction box 2 that are fixedly connected to each other. The main housing 1 and the junction box 2 are both made of flame-resistant plastic material at a fireproofing grade of 5VA. In order to prevent fire, the lamps are usually made of metal materials rather than plastic materials, which would result in increased weight and inconvenient installation, transportation, and lamps cooling. The main housing 1 is a cylindrical structure having an open end, a closed end and an accommodating space formed therein. A light transmission component 3 is fixed to the opening 11 at the open end. An LED light-emitting assembly 4 is disposed in the accommodating space. The closed end of the main housing 1 is fixedly connected to the junction box 2.

Spring clips 5 are hinged respectively at symmetrical positions on the outer circumferential surface of the end of the main housing 1 that is close to the opening 11. The spring clips 5 are configured to expand outward and get stuck against the sidewall of the mounting hole when the LED downlight is mounted at an installation position. The periphery of the opening 11 of the main housing 1 is provided with an annular mounting surface 12 extending radially outwards. Inside the mounting surface 12 is the opening 11, to which the light transmission component 3 is fixed. Preferably, the light transmission component 3 is fixed to the opening 11 of the main housing 1 by a mounting ring 6. The inner circumferential surface of the mounting ring 6 is provided with a plurality of first snap-fit projection 61, the first snap-fit projection 61 disposed evenly in the circumferential direction of the mounting ring 6, and an edge of the light transmission component 3 is mounted into the first snap-fit projection 61 of the mounting ring 6 in snap-fit manner. The outer circumferential surface of the mounting ring 6 is provided with a plurality of fixture blocks 62 projecting outwards and disposed evenly in the circumferential direction of the mounting ring. Accordingly, the inner circumferential surface of the opening 11 is provided with a plurality of first grooves 13 recessed inwards. The first grooves 13 match the fixture blocks 62 respectively in number and shape, such that the mounting ring 6 and the light transmission component 3 are both fixed to the opening 11 of the main housing 1 and cover the entire opening 11. The light transmission component 3 may be a transparent plate or a lens. In this embodiment, the mounting surface 12 includes a plurality of step surfaces 121 arranged continuously in an axial direction of the main housing 1, and a planar portion 122 outside the step surfaces 121 and perpendicular to the axial direction of the main housing 1. The inclined surface formed by the plurality of continuous step surfaces 121 is tilted with respect to the axial direction of main housing 1.

Preferably, the outer circumferential surface of the main housing 1 is provided with mounting blocks 14 symmetrically arranged, and each mounting block 14 is provided with a mounting portion 141 for hinging the spring clip 5. The main housing 1 is provided with an LED light-emitting assembly 4 therein. Preferably, the LED light-emitting assembly 4 is fixed on a heat sinking component 7, which is a bowl-shaped component with an outer circumferential surface that matches the main housing 1. The heat sinking component 7 divides the accommodating space in the main housing 1 into an upper portion near the open end and a lower portion near the closed end. In the upper portion of the accommodating space, the LED light-emitting assembly 4 is fixed on the heat sinking component 7 by a screw. The LED light-emitting assembly 4 includes a substrate 41 and a plurality of LED light emitting units 42 located on the substrate 41. The LED light emitting unit may be an LED chip or an LED lamp bead.

In the lower portion of the accommodating space of the main housing 1 under the heat sinking component 7, an IC constant-current power supply 8 is fixed inside the main housing 1. The junction box 2 is fixed outside the closed end of the main housing 1. The IC constant-current power supply 8 is provided with a connection wire 81 extending into the junction box 2 through the aperture on the closed end of the main housing 1 and the aperture on the junction box 2. The peripheral wall of the junction box 2 is provided with a plurality of holes 21, through which the external power cable is inserted to connect to the connection wire 81.

Figure 2:
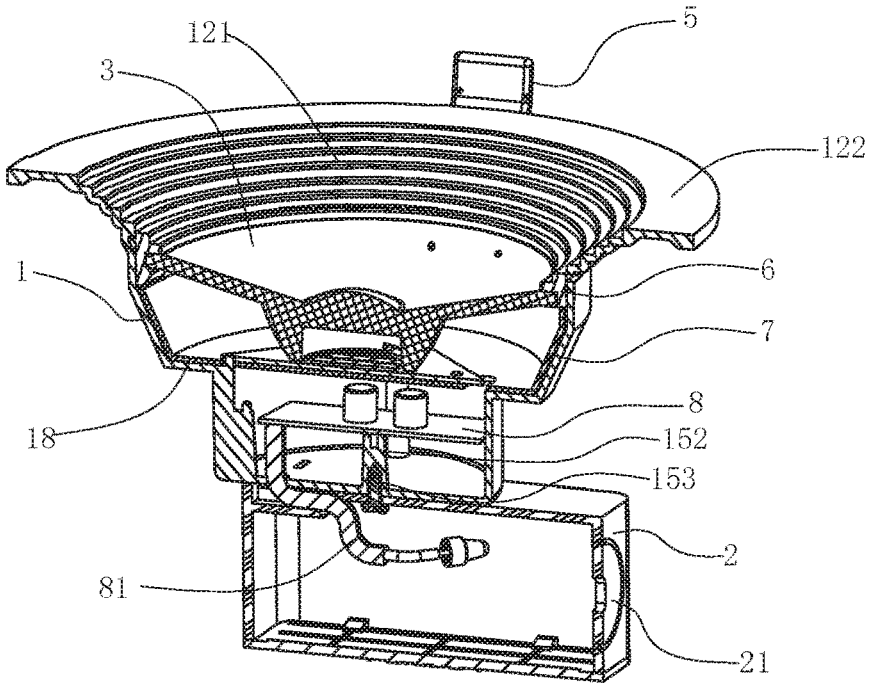
FIG. 2 is a sectional view taken along the line A-A of FIG. 1.
Figure 3:
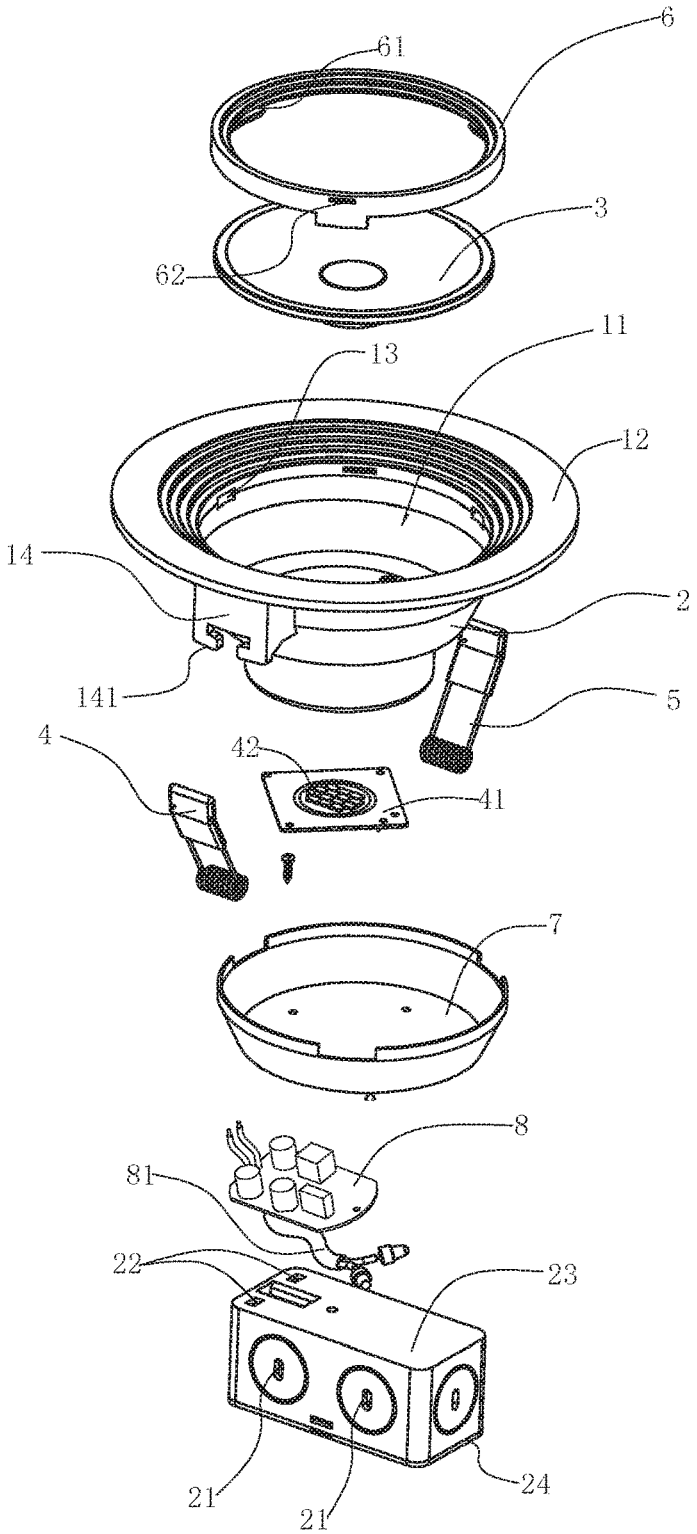
FIG. 3 is an exploded view of an embedded LED downlight according to the first embodiment of the present invention.
Figure 4:
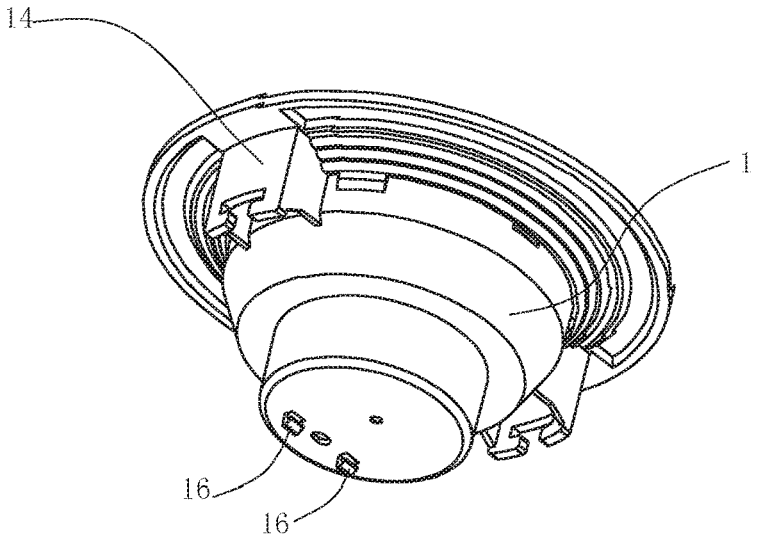
FIG. 4 is a schematic view of a main housing of an embedded LED downlight according to the first embodiment of the present invention.
Figure 5:
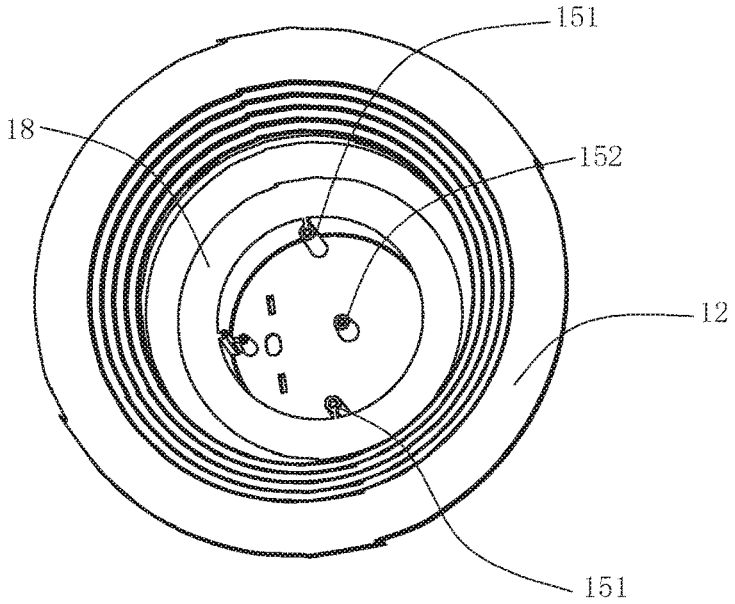
FIG. 5 is a schematic view of the main housing of the embedded LED downlight viewed from another direction according to the first embodiment of the present invention.
Figure 6:
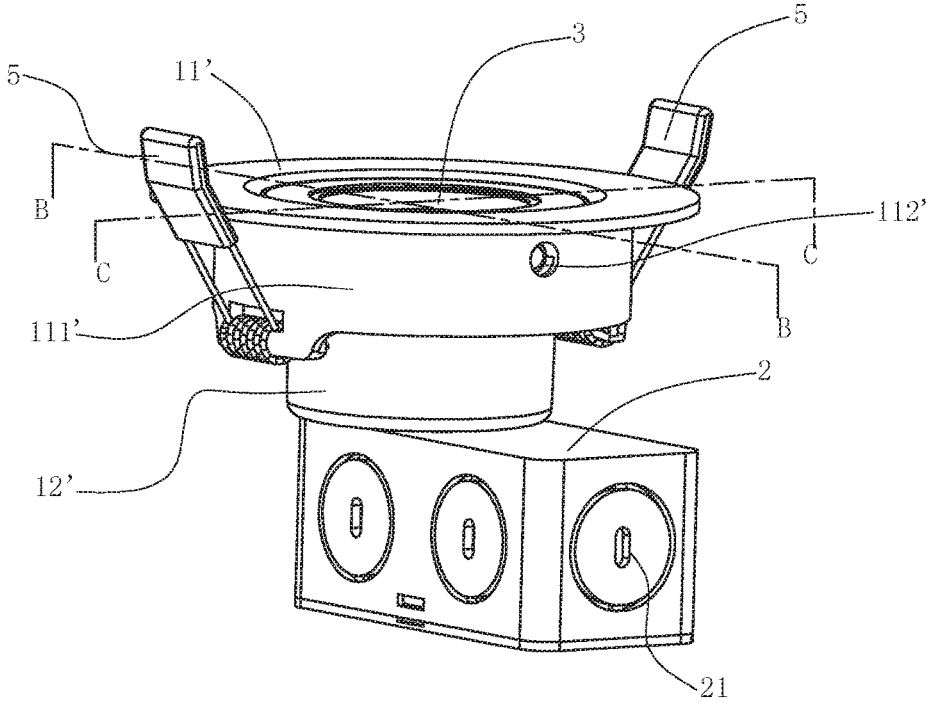
FIG. 6 is a schematic perspective view of an embedded LED downlight according to a second embodiment of the present invention.
Figure 7:
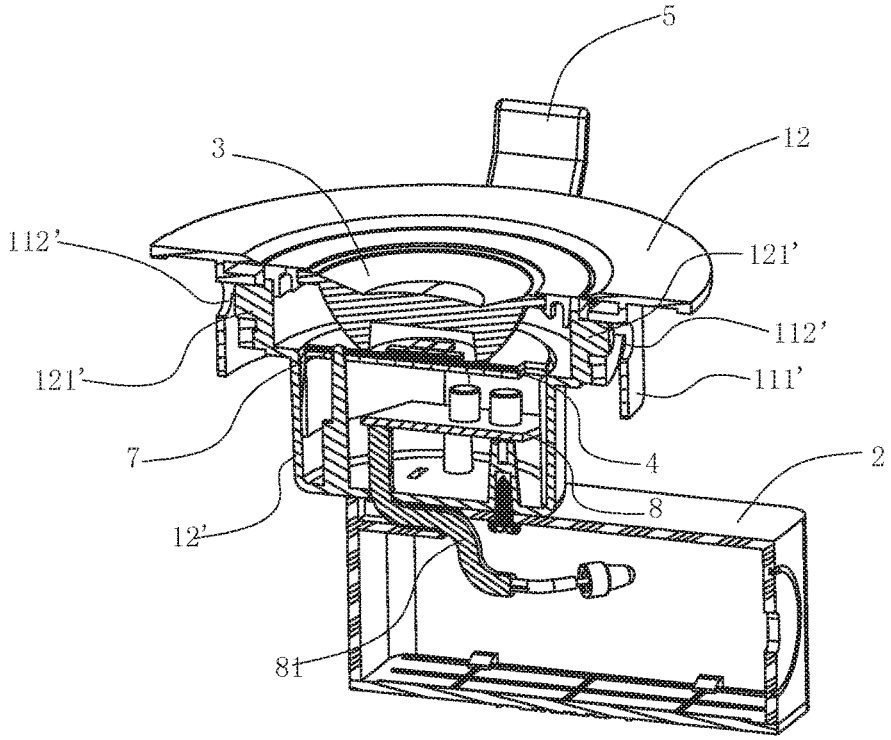
FIG. 7 is a sectional view taken along the line B-B of FIG. 6.
Figure 8:
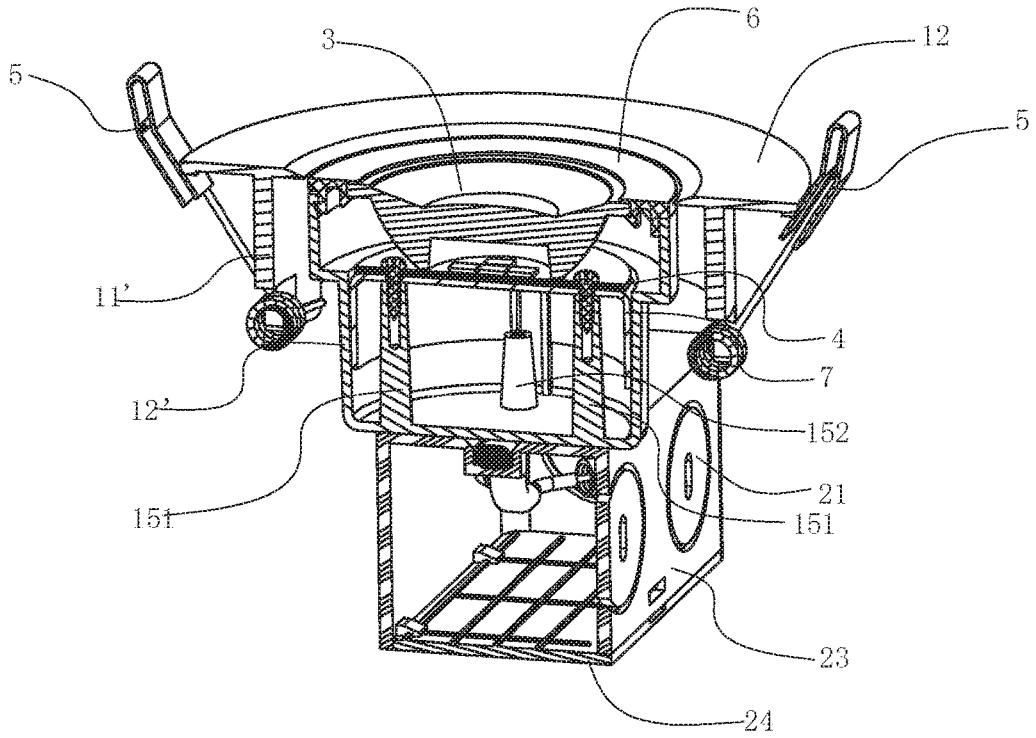
FIG. 8 is a sectional view taken along the line C-C of FIG. 6 (an IC constant-current power supply is omitted).
Figure 9:
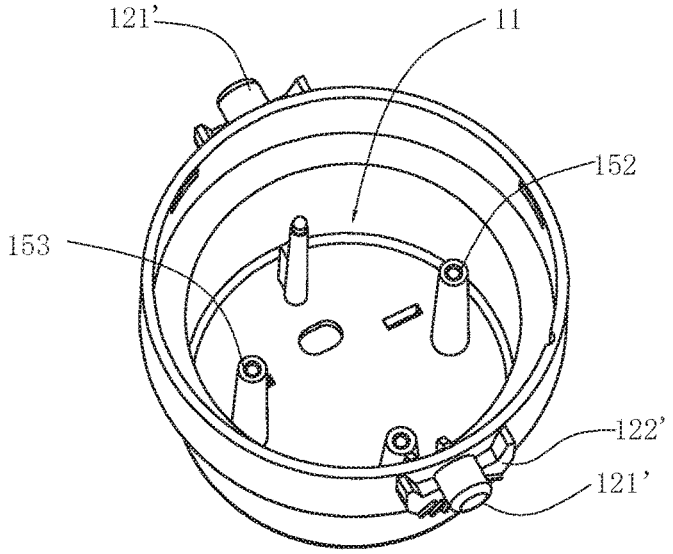
FIG. 9 is a schematic view of a second portion of a main housing according to the second embodiment of the present invention.
Figure 10:
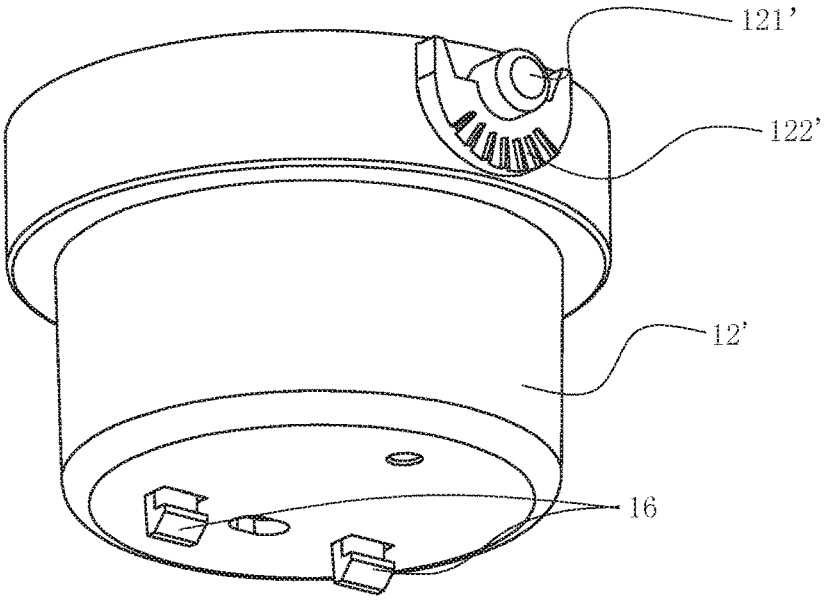
FIG. 10 is a schematic view of the second portion of the main housing viewed from another direction according to the second embodiment of the present invention.
Figure 11:
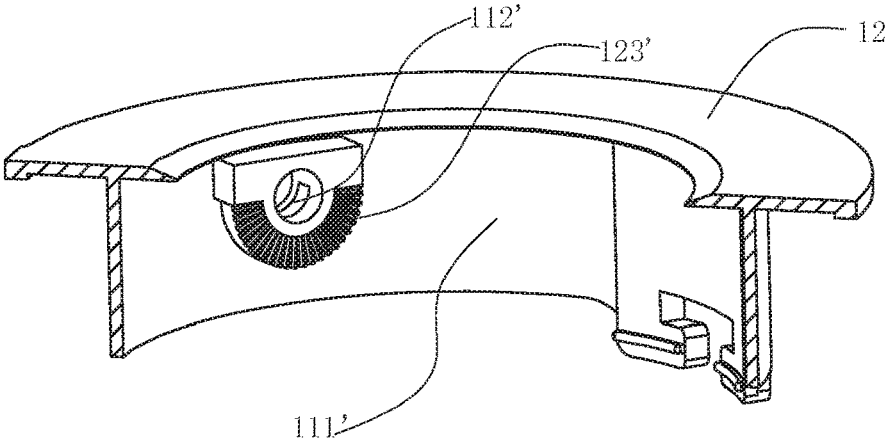
FIG. 11 is a sectional view of a first portion of the main housing according to the second embodiment of the present invention.
Figure 12:
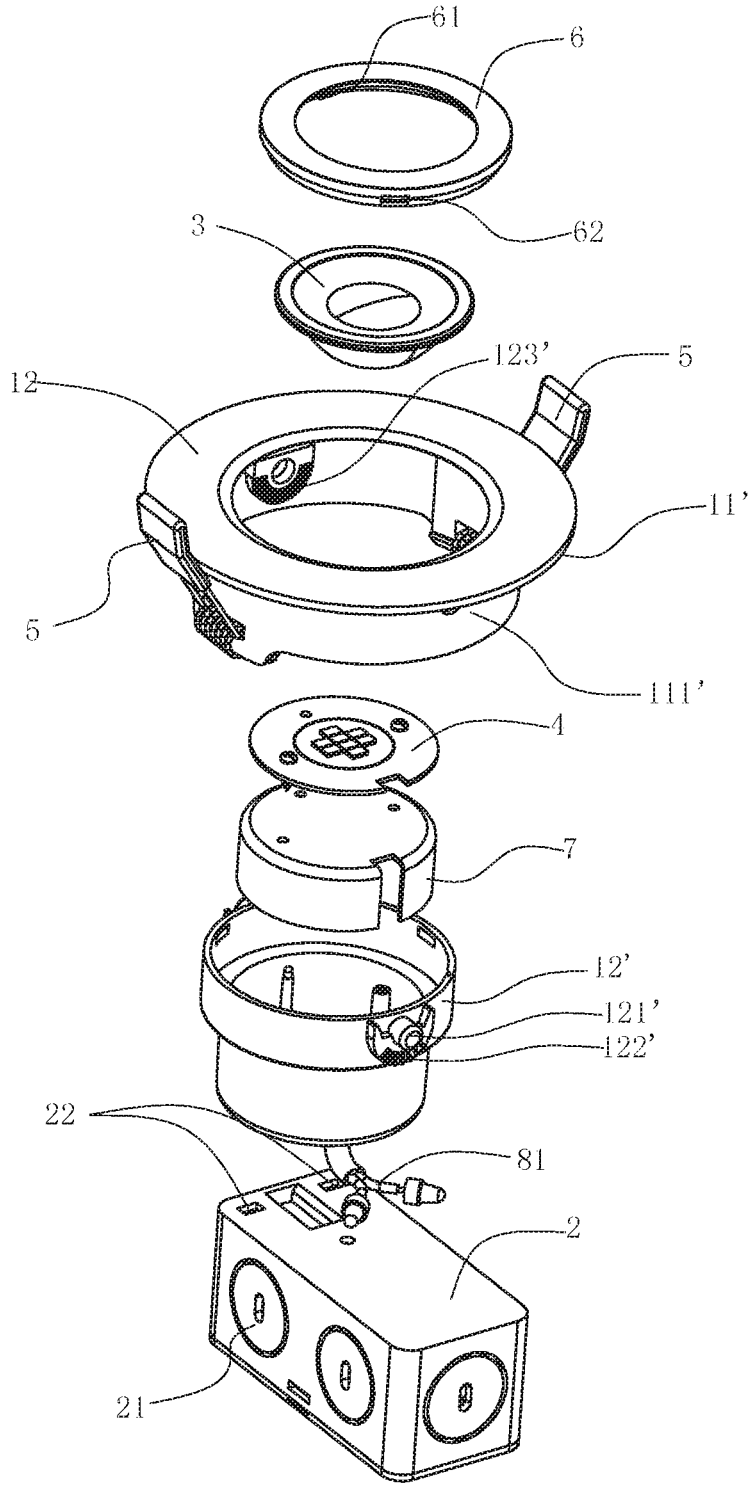
FIG. 12 is an exploded view of an embedded LED downlight according to the second embodiment of the present invention.

An inner surface of the closed end of the main housing 1 is provided with a first connecting post 151, a second connecting post 152 and a third connecting post 153 extending towards the open end. The first connecting post 151 extends to the heat sinking component 7 and is provided with a hole that opens upwards and is configured to receive an inserted screw so as to connect the heat sinking component 7 and LED light-emitting assembly 4 to the first connecting post 151. The second connecting post 152 extends to the IC constant-current power supply 8 and is fixedly connected to the IC constant-current power supply 8 by a screw. The first connecting post 151 is located at a peripheral position inside the main housing 1 while the second connecting post 152 is located in the position near the center of the main housing 1, since the IC constant-current power supply 8 is closer to the closed end of the main housing 1 than the heat sinking component 7. The third connecting post 153 is provided with a hole that opens downward and expose the outer surface of the closed end of the main housing 1. By inserting a screw from the side of the junction box 2 to the third connecting post 153, the junction box 2 is fixedly connected to the main housing 1. As shown in FIG. 2, preferably, the second connecting post 152 and the third connecting post 153 are one and the same connecting post in which an upward hole and a downward hole are formed respectively.

Also, the outer surface of the closed end of the main housing 1 is provided with a second snap-fit projection 16 extending outwards. The surface of the junction box 2 that is fixed to the main housing 1 is provided with a second groove 22, and the second snap-fit projection 16 is mounded into the second groove 22 in snap-fit manner so that the junction box 2 and the main housing 1 are connected to each other and are aligned with each other when assembled. The inner circumferential surface of the main housing 1 is provided with a step surface 18 projecting inwards. The step surface 18 is matched with the heating sinking component 7 for disposing the heating sinking component 7 thereon.

The junction box 2 also includes a box body 23 provided with an opening which is covered by a cover 24. The cover 24 is fixed to the box body 23in a snap-fit manner, such that the assembly and disassembly thereof are more convenient.

FIGS. 6-11 shows a second embodiment of the embedded LED downlight. This embodiment has similar structures to the first embodiment except that the main housing 1' comprises two portions mutually nested, respectively a first portion 11' and a second portion 12'. The second portion 12' is a cylindrical component comprising a closed end and an open end having an opening 11. The first portion 11' encloses the open end of the second portion 12' from outside. The first portion 11' comprises an annular circumferential surface 111' extending in the same direction as the second portion 12' and outside the second portion 12', and a mounting surface 12 extending outwards in a radial direction of the second portion 12' at the opening of the second portion 12' and located outside the edge of the opening 11. Spring clips 5 are hinged at symmetrical positions on the annular circumferential surface 111' and configured to mount the embedded LED downlight. The annular circumferential surface 111' of the first portion is provided with two hinge holes 112' at positions centro-symmetrical to each other. The outer circumferential surface of the second portion 12' is provided with two hinge shafts 121' projecting outwards at symmetrical positions in a radial direction. The hinge shaft 121' are matched with the hinge hole 112' respectively, and inserted into the hinge hole 112' respectively, so that the second portion 12' is rotatable around the hinge shaft 121' with respect to the first portion 11'. A first tooth profile 122' surrounding the hinge shaft 121' is provided around the hinge shaft 121', and a second tooth profile 123' surrounding the hinge hole 112' is provided around the hinge hole 112'. The first tooth profile 122' and the second tooth profile 123' mate with each other such that when the second portion is rotated with respect to the first portion, the first tooth profile engage with the second tooth profile. Further, the first tooth profile and the second tooth profile have certain elasticity such that they can be detached from each other and the engagement position can be changed, such that the first portion 11' and the second portion 12' may be located at a certain position. The first tooth profile 122' and the second tooth profile 123' are disposed on ¼ turn or more of a circle around the hinge shaft 121' and the hinge hole 112', respectively, such that the second portion may be rotatable with respective to the first portion in a large range of angles. When the first portion 11' is mounted outside a mounting hole, the second portion and other components of the first portion are all housed in the mounting hole, and the second portion can be rotated relative to the first portion thereby adjusting the irradiation angle of the second portion.

In the above-mentioned second embodiment, the light transmission component 3, the light emitting element 4, the IC constant-current power supply 8 and the heat sinking component 7 are all disposed in the second portion 12' of the main housing 1, and the heat sinking component 7 also divides the space within the second portion 12' into an upper portion and a lower portion. The IC constant-current power supply 8 is provided in the lower portion, and the light emitting element 4 is provided in the upper portion. The first connecting post 151, the second connecting post 152, and the third connecting post 153 extending towards the open end are also provided on the inner surface of the closed end of the second portion 12', and are configured to be also used to connect the heat sinking component 7, the IC constant-current power supply 8, and the junction box 2, respectively.

Since most portion of the embedded LED downlight is made of flame-resistant plastic material at a fireproofing grade of 5VA (同上 疑 问), the lamp not only has a more compact overall structure and a light weight, but also is of great convenience in installation and disassembly. Moreover, the embedded LED downlight disclosed herein has simple production process, high production efficiency and low material consumption, and further may be manufactured by injection molding, thereby reducing the production cost of the product.

The invention claimed is:

1. An embedded LED downlight, comprising a main housing (1) and a junction box (2) fixedly connected to each other, wherein:

the main housing (1) is of cylindrical structure having an open end, a closed end and an accommodating space formed therein;

a light transmission component (3) is fixed to an opening (11) at the open end;

an LED light-emitting assembly (4) and an IC constant-current power supply (8) are disposed in the accommodating space;

the closed end of the main housing (1) is fixedly connected to the junction box (2);

spring clips (5) are hinged at symmetrical positions on an outer circumferential surface of the main housing (1) close to the opening (11), respectively; and the main housing (1) and the junction box (2) are both made of flame-resistant plastic material at a fireproofing grade of 5VA.

2. The embedded LED downlight according to claim 1, wherein the open end of the main housing (1) is provided with an annular mounting surface (12) extending outwards radially, the opening (11) is formed at an inner side of the mounting surface (12), and the light transmission component (3) is fixed to the opening (11) by a mounting ring (6).

3. The embedded LED downlight according to claim 2, wherein an inner circumferential surface of the mounting ring (6) is provided with a first snap-fit projection (61) projecting inwards, an edge of the light transmission component (3) is mounded into the first snap-fit projection (61) in snap-fit manner to be fixedly connected to the mounting ring (6), and an outer circumferential surface of the mounting ring (6) is provided with a fixture block (62) projecting outwards, an inner circumferential surface of the opening (11) is provided with a first groove (13) matching with the fixture block (62) so that the mounting ring (6) is fixed to the opening (11).

4. The embedded LED downlight according to claim 1, wherein a heat sinking component (7) is fixed inside the main housing (1), the heat sinking component (7) divides the accommodating space into an upper portion close to the open end and a lower portion close to the closed end, the LED light-emitting assembly (4) is fixed in the upper portion and is fixed on the heat sinking component (7), and the IC constant-current power supply (8) is fixed in the lower portion.

5. The embedded LED downlight according to claim 4, wherein an inner surface of the closed end of the main housing (1) is provided with a first connecting post (151), a second connecting post (152) and a third connecting post (153) extending towards the opening (11), the first connecting post (151) extends to the heat sinking component (7) and is fixedly connected to the heat sinking component (7), the second connecting post (152) extends to the IC constant-current power supply (8) and is fixedly connected to the IC constant-current power supply, and the third connecting post (153) has a hole exposing the outer surface of the closed end, and is fixedly connected to the junction box (2).

6. The embedded LED downlight according to claim 5, wherein an outer surface of the closed end of the main housing (1) is provided with a second snap-fit projection (16) extending outwards, a surface of the junction box (2) fixed to the main housing (1) is provided with a second groove (22), and the second snap-fit projection (16) is mounted into the second groove (22) in snap-fit manner so that the junction box (2) and the main housing (1) are connected to each other.

7. The embedded LED downlight according to claim 1, wherein a connection wire (81) is fixed on the IC constant-current power supply (8), the connection wire (81) passes through the main housing (1) and extends into the junction box (2), and a peripheral wall of the junction box (2) is provided with a plurality of holes (21) through which an external power cable is inserted to connect to the connection wire (81).

8. The embedded LED downlight according to claim 1, wherein the main housing (1) comprises two portions mutually nested, respectively a first portion (11') and a second portion (12'), the second portion (12') is a cylindrical component having an open end, a closed end and the accommodating space formed therein, the first portion (11') encloses the open end of the second portion (12') from outside.

9. The embedded LED downlight according to claim 8, wherein the first portion (11') comprises an annular circumferential surface (111') extending in the same direction as the second portion (12') and outside the second portion (12'), the annular circumferential surface (111') is provided with two hinge holes (112') symmetrical to each other, an outer circumferential surface of the second portion (12') is provided with two hinge shafts (121') at symmetrical positions in a radial direction; and the hinge shaft (121') are inserted into the hinge hole (112') respectively so that the second portion (12') is rotatable around the hinge shaft (121') with respect to the first portion (11').

10. The embedded LED downlight according to claim 9, wherein a first tooth profile (122') surrounding the hinge shaft (121') is provided around the hinge shaft (121'), a second tooth profile (123') surrounding the hinge hole (112') is provided around the hinge hole (112'), and the first tooth profile (122') and the second tooth profile (123') have elasticity and engage with each other.

* * * * *